United States Patent [19]

Dudley

[11] Patent Number: 4,458,894

[45] Date of Patent: Jul. 10, 1984

[54] PORTABLE SUPPORT BAR ASSEMBLY

[75] Inventor: David E. Dudley, San Jose, Calif.

[73] Assignee: In-Door Gym, Los Gatos, Calif.

[21] Appl. No.: 428,704

[22] Filed: Sep. 30, 1982

[51] Int. Cl.[3] ..... A63B 1/00

[52] U.S. Cl. ..... 272/62; 272/900

[58] Field of Search ..... 272/62, 63, 93, 109, 272/112, 117, 144, 900; 211/182; 248/225.1, 251; 108/149, 152, 108, 114

[56] References Cited

U.S. PATENT DOCUMENTS

| | | | |
|---|---|---|---|
| D. 197,076 | 12/1963 | Spackman et al. | 272/62 |
| D. 208,924 | 10/1967 | Brenner | 272/63 |
| 1,263,724 | 4/1918 | Zagora | 248/225.1 |
| 1,357,524 | 11/1920 | Schwinger | 248/225.1 |
| 2,633,998 | 4/1953 | Derman | 108/149 |
| 3,593,996 | 7/1971 | Thompson | 272/62 |
| 3,874,657 | 4/1975 | Niebojewski | 272/63 |
| 4,018,437 | 4/1977 | LoPresti | 272/112 |

*Primary Examiner*—Richard J. Apley
*Assistant Examiner*—S. R. Crow
*Attorney, Agent, or Firm*—Thomas E. Schatzel

[57] ABSTRACT

A portable support assembly for mounting a doorway comprising means for engaging a first horizontal bar to the interior of a door jamb and the means for supporting a second horizontal support bar outwardly from the door jamb and above the elevation of the door jamb.

6 Claims, 5 Drawing Figures

PORTABLE SUPPORT BAR ASSEMBLY

BACKGROUND OF THE INVENTION

1. Field of the Invention

This invention relates to exercise support bar assemblies and more particularly to a portable support bar assembly for mounting above a doorway.

2. Description of the Prior Art

There has been considerable activity in recent years regarding physical exercise of individuals. This encompasses a great deal of consideration for personal exercises performed with the individual supported in an elevated position. This even includes supporting an individual in an inverted elevated position. For example, U.S. Pat. No. 3,380,447 granted to Robert M. Martin discloses ankle devices to engage an elevated bar for supporting an individual in an elevated inverted position. Also many exercises are conducted from an elevated position in an upright position.

Accordingly, there is a need for support bar assemblies capable of supporting an individual in an elevated position. U.S. Pat. No. 3,707,285 granted to Robert M. Martin discloses a horizontal bar exercising device. This device is relatively complex and is designed to be supported intermediate a ceiling wall and a floor by contacting both the floor and ceiling wall. U.S. Pat. No. 3,525,521 by P. Sylvester discloses an exercise bar which may be mounted within a door frame and is capable of supporting an individual so long as the extremities of the individual do not extend beyond the distance of the floor or the bar within the door frame. Thus, since many people, with their arms extended in an elevated position have longitudinal dimensions exceeding the height of doorways, such a bar has limited use. U.S. Pat. No. 3,738,650 granted to Ossenkop et al, discloses a similar bar to that of the Sylvester patent. U.S. Pat. No. 3,915,452 discloses a portable chinning bar assembly. This too limits the height of the bar to that within the door frame.

Accordingly, there is a need for a support bar assembly which may be supported within a door framing but wherein the horizontal support bar itself is above the elevation of the door.

SUMMARY OF THE INVENTION

It is an object of the present invention to provide a portable support bar assembly for mounting about a doorway and wherein the horizontal support bar may be positioned above the level of the top of the door casing.

It is a further object of the present invention to provide a portable support bar assembly wherein the width of the assembly is readily adjustable.

It is a further object of the present invention to provide a portable support bar assembly which may be readily placed into position for use and removed after use.

It is a further object of the present invention to provide a portable support bar assembly which is of uncomplicated structure, safe in use and economical to manufacture.

It is a further object of the present invention to provide a portable support bar assembly wherein a person may be supported by the person's hands or about the person's feet.

It is a further object of the present invention to provide a portable support bar assembly which can be used in any standard door opening regardless of whether the door is hung to the left or to the right.

It is a further object of the present invention to provide a portable support bar assembly which does not mar a room facing surface of doorways.

A preferred embodiment of a support bar assembly of the present invention includes a first horizontal elongated member which may be positioned intermediate the inner facing walls of a door casing. The first horizontal member is engaged to a pair of V-shaped members which are permanently fastened to the horizontal elongated member at the vertex of each of the support members. One leg of each V-shape member projects outwardly and upwardly from the horizontal member and the other leg projects outwardly and downwardly from the elongated member. The downwardly projecting arms each have a stub projecting outwardly therefrom and parallel to the horizontal member so as to engage the room facing surfaces of the doorway. A second horizontal member is engaged to the upwardly and outwardly projecting arms of the V-shaped member. A pair of cross-struts are engaged between the ends of the V-shape member. Accordingly, when in position the first horizontal elongated member is engaged about its ends to the interior of the door casing. The stubs from the V-shape members then interface with the wall facing surfaces of the doorway casing. This supports the second horizontal member in an elevated position above the level of the door casing and projecting outwardly from the wall of the room. Accordingly an individual may grasp the second horizontal bar by his or her hands or the individual may be supported about the ankles by said bar.

An advantage of the structure of the present invention is that it provides for a portable support bar assembly which may be readily engaged about a standard doorway casing and wherein the horizontal support bar is elevated above the level of the doorway casing.

It is a further advantage of the present invention that it provides a support bar assembly wherein the width may be readily adjusted by providing telescoping horizontal members.

It is a further advantage of the present invention that it provides a portable support bar assembly which may be readily set up for use and removed after use.

It is a further advantage of the present invention that it provides for an uncomplicated, safe and economical structure.

These and other objects and advantages of the present invention will no doubt become obvious to those of ordinary skill in the art after having read the following detailed decription of the preferred embodiment which are illustrated in the various drawing figures.

IN THE DRAWINGS

DETAILED DESCRIPTION OF THE PREFERRED EMBODIMENT

Figure 1:
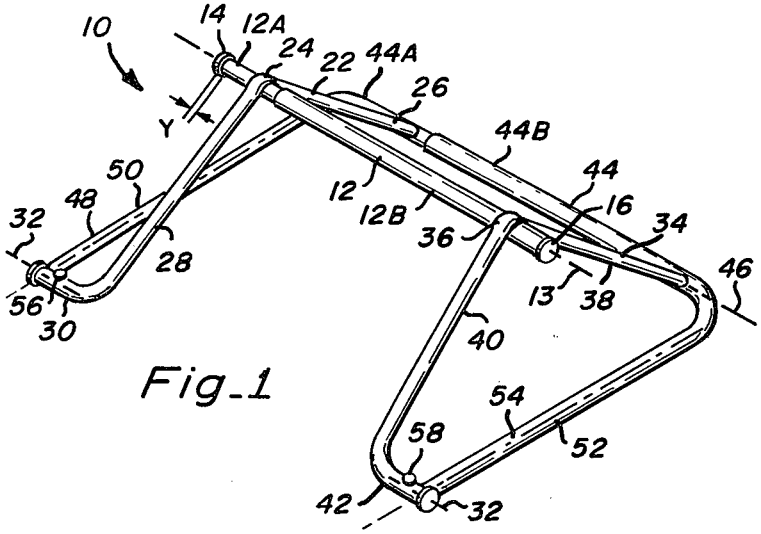
FIG. 1 is a perspective view of a portable support bar assembly of the present invention as viewed from its back side.

FIGS. 1–4 illustrate a portable, adjustable support bar assembly of the present invention and referred to by the general reference character 10. The assembly 10 includes a first horizontal elongated bar 12 which is comprised of two telescoping cylindrical members 12*a* and 12*b* coaxial about an axis 13. The cross-sectional diameter of the section 12*a* is less than that of 12*b* such that it slides within the interior of 12*b*. The member 12*a* has a flared end 14 and the member 12*b* has a flared end 16. The body 12 is adapted such that its extremities may be positioned within the interior of a door casing and mounted about the facing sides 18 and 20 of a door jamb.

The tube 12*a* is engaged to a substantially V-shaped member 22 which is engaged about its vertex 24 to the bar 12*a*. The V-shape member 22 has a first leg 26 and a second leg 28. The leg 28 has a stub 30 projecting outwardly therefrom and along an axis 32 which is parallel to the axis 13 of the bar 12. The bar 12*b* is engaged to a substantially V-shape member 34 about a vertex 36 of the member 34. The member 34 has a leg 38 projecting from the vertex 36 and a leg 40 projecting from the vertex 36. A stub 42 projects from the arm 40 and terminates along the axis 32.

A second horizontal elongated member 44 includes a first cylindrical segment 44*a* and a second cylindrical segment 44*b* coaxial with an axis 46. The diameter of the segment 44*a* is less than that of segment 44*b* such that segment 44*a* may slide within the interior of segment 44*b*. The segment 44*a* is welded or otherwise secured to the terminal end of the arm 26. The segment 44*b* is welded or otherwise secured to the arm 38. Members 44*a* and 44*b* are positioned along the longitudinal axis 46 which is parallel to axes 13 and 32. A strut 48 is engaged about one end to the stub 30 and about its other end to the segment 44*a*. As illustrated the strut 48 is an extension of the segment 44*a* by bending it so that it has an axis 50 which is perpendicular to the axes 13, 32 and 46. A strut 52 is engaged about one end to the stub 42 and about the other end to the segment 44*b*. The strut 52 has an axis 54 which is perpendicular to the axes 13, 32 and 46 and parallel to the axis 50. The strut 52 is illustrated as being an extension of the segment 44*b* and bent such that its axis 54 is perpendicular to the axes 13, 32 and 46.

About the outer surface of the stub 30 and facing the door casing is a bumper 56. Likewise, about the outer surface and the end of the stub 42 and facing the inside facing surface of the doorway is a bumper 58.

Figure 5:
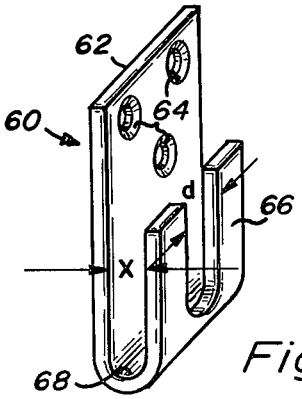
FIG. 5 is a perspective view of a door jamb bracket to be mounted on a doorway jamb.

FIG. 5 illustrates a perspective view of a bracket referred to by the general reference character 60 for mounting on the interior facing surfaces of a door jamb. The bracket 60 includes a flat plate 62 which establishes a plane parallel with the plane of the inner surface of the door jamb. A plurality of apertures 64 are included in the plate 62 so that screws may be utilized to fasten the plate to the door jamb surface. Projecting outwardly from and in a plane parallel to the plate 62 is a U-shape guideway 66. The guideway 66 is supported outwardly from the plate 62 by means of a support stub 68. In manufacture, the plate 60, U-shape guideway 66 and stub 68 may all be made from a unitary piece. The distance "d" of the U-shape opening in the guideway 66 is of a distance which is slightly greater than the diameter of the bar 12*b* or 12*a* such that the bar 12 may be cradled within the opening of the guideway 66. The distance "X" between the plate 62 and the guideway 66 is greater than the thickness "Y" of the flares 14 and 16. Thus, the flared ends of the bar 12 may be supported with the flared ends intermediate the associated plate 62 and 66 and cradled by the guideways 66.

Figure 2:
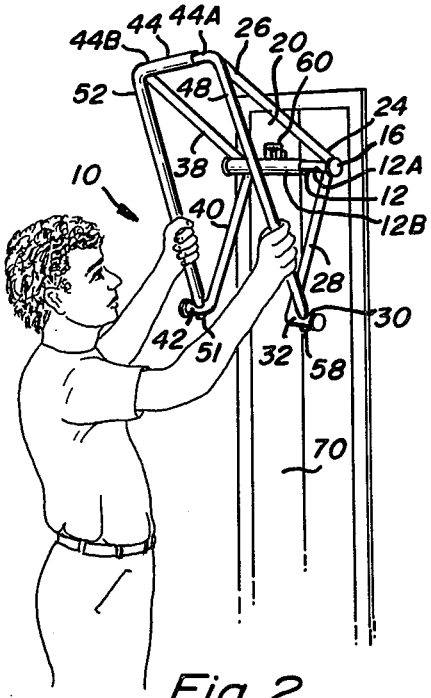
FIG. 2 is a fragmentary perspective view of the support bar assembly of FIG. 1 shown in the process of being mounted in place on a doorway casing.

Thus, when it is desired to mount the apparatus 10 in place about a door jamb 70, as illustrated in FIG. 2, the individual merely adjusts to the desired width by grasping the struts and urging them laterally inwardly or outwardly depending upon the desired width according to the door jamb 70. The flared ends 14 and 16 are positioned to be cradled by the U-shape guideways. This completes the mounting.

Figure 3:
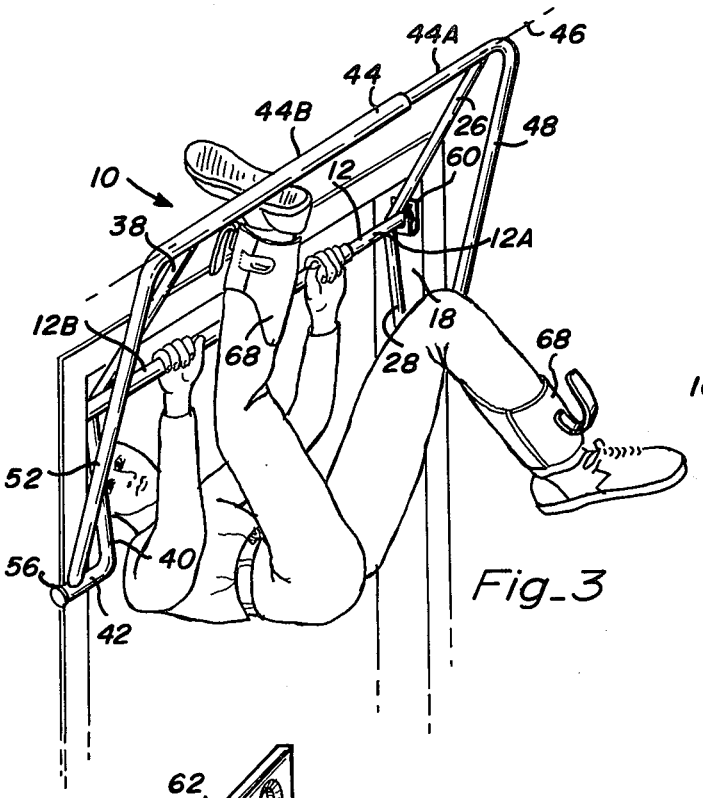
FIG. 3 is a fragmentary perspective view of the support bar assembly of FIG. 1 shown by an individual in the process of mounting for inverted support.
Figure 4:
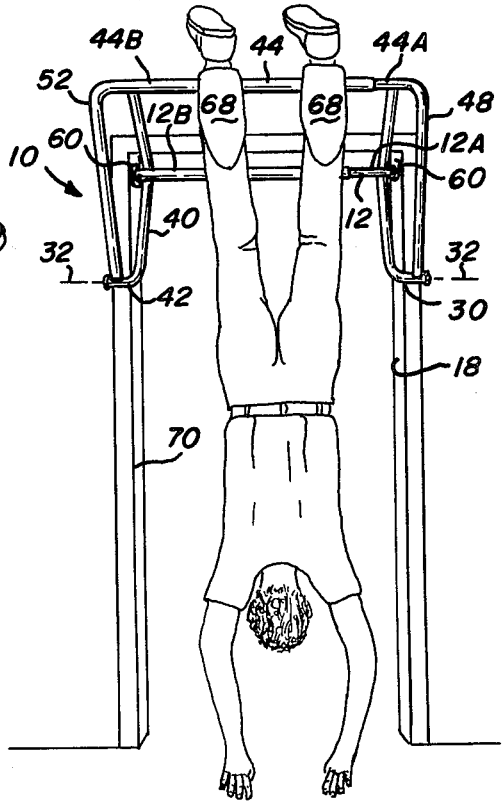
FIG. 4 is a fragmentary perspective view of the support bar assembly of FIG. 1 shown in the process of supporting an individual in the inverted position.

Then, as illustrated in FIG. 3, an individual may grasp the horizontal bar 12 and kick his or her feet up so that the horizontal bar 44 may be engaged by a pair of ankle devices 68. As illustrated in FIG. 4 the individual may then be supported in the inverted position. Needless to say if the individual wants to be supported in an upright position he merely grabs the bar 44 by his hands. It may be noted that the support bar 44 is elevated above the door jamb 70 such that the extremities of the body of the exerciser have further to extend without touching the floor when supported. It may be further noted that the bumpers 56 and 58 on the stubs prevent metal contact between the room facing surfaces of the door jamb 70 and the device. Thus, there is no marring or marking of the surface of the doorway casings.

After use, to remove the device 10, an individual merely removes the ends 14 and 16 from the guideways 66 and carries the device 10 away.

Although the present invention has been described in terms of the present preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as follows in the true spirt of the scope of the invention.

I claim:

1. A portable support bar assembly for mounting about a doorway comprising a first elongated member having a first end and a second end;

a first substantially V-shaped member having an upper leg joined to a lower leg, said V-member being engaged at a vertex formed by said upper and lower legs to the first horizontal elongated member adjacent said first end thereof, the first V-shaped member having a first stub projecting from said lower leg, said first stub being parallel to the first horizontal elongated member and beyond the terminus of said first end;

a second substantially V-shaped member having an upper leg joined to a lower leg, said V-shaped member being engaged at a vertex formed by said upper and lower legs to the first horizontal elongated member adjacent said second end thereof, the second V-shaped member having a second stub projecting from said lower leg, said second stub being parallel to the first horizontal member and beyond the terminus of said second end;

a second horizontal elongated member having a first end and a second end and engaged about its said first end to the upper leg of the first V-shaped member and about its said second end to the upper leg of the second V-shaped member;

a first cross strut engaged about said first end of the second horizontal elongated member and about said lower leg of said first V-shaped member;

a second cross strut engaged about said second end of the second horizontal elongated member and about said lower leg of said second V-shaped member;

a first and second bracket means for mounting on opposite inner-facing surfaces of a doorway frame; and means for engaging the first and second bracket means to said first and second ends of the first horizontal member.

2. The portable support bar assembly of claim 1 wherein the first horizontal elongated member comprises a first and a second tubular member, with said first member being slidable within said second member in a telescoping fashion; and the second horizontal elongated member comprises a first and a second tubular member with said first tubular member being slidable within said second tubular member in a telescoping fashion;

whereby the first and second horizontal members may be telescoped.

3. The portable support bar assembly of claim 1 or 2 wherein the first V-shaped member is engaged to the first horizontal elongated member with said upper leg of the first V-shaped member projecting upwardly and outwardly from the first horizontal elongated member; and the second V-shaped member is engaged to the first horizontal elongated member with said upper leg of the second V-shaped member projecting upwardly and outwardly from the first horizontal elongated member;

whereby the second horizontal elongated member is elevated, parallel and projecting outward relative to the first horizontal elongated member.

4. The portable support bar assembly of claim 1 or 2 wherein the first and second bracket means each include a flat plate section within a first plane, a U-shaped guideway within a second plane parallel with and adjacent to said first plane and a support supporting said plate and guideway in place with a spacing intermediate the width of said guideway being at least equal to the outer cross-sectional dimension of the first elongated member; and the first elongated horizontal member being flared about its said first and second ends with the cross-sectional dimension of said flares each being greater than said width of said guideway.

5. The portable support bar assembly of claim 2 wherein the first V-shaped member is engaged to the first horizontal elongated member with said upper leg of the first V-shaped member projecting upwardly and outwardly from the first horizontal elongated member; and the second V-shaped member is engaged to the first horizontal elongated member with said upper leg of the second V-shaped member projecting upwardly and outwardly from the first horizontal elongated member whereby the second horizontal elongated member is elevated, parallel and projecting outward relative to the first horizontal elongated member;

the first and second bracket means each include a flat plate section within a first plane, a U-shaped guideway within a second plane parallel with and adjacent with said first plane and a support supporting said plate of guideway in place with a spacing intermediate the width of said guideway being at least equal to the outer cross-sectional dimension of the first elongated member; and the first elongated horizontal member being flared about its first and second ends with the cross-sectional dimensions of said flares each being greater than said width of said guideway.

6. The portable support bar assembly of claim 1, 2 or 5 further including a first bumper means engaged to said stub of said first V-shaped member for cushioning the interface of said stub with the surface of a doorframe; and a second bumper means engaged to said stub of said second V-shaped member for cushioning the interface of said stub with the surface of a doorframe.

* * * * *